US005628088A

United States Patent [19]

Chen

[11] Patent Number: 5,628,088

[45] Date of Patent: May 13, 1997

[54] MULTISTAGE ADJUSTABLE DEVICE FOR TRUNK BRACKET

[76] Inventor: Chang-Wen Chen, 58, Ma Yuan West St., Taichung, Taiwan

[21] Appl. No.: 508,948

[22] Filed: Jul. 24, 1995

[51] Int. Cl.[6] ..... B25G 1/04

[52] U.S. Cl. ..... 16/115; 190/18 A

[58] Field of Search ..... 16/115; 190/39, 190/115, 117, 14, 15 R, 104, 18 R, 18 A

[56] References Cited

U.S. PATENT DOCUMENTS

| | | | |
|---|---|---|---|
| 5,400,472 | 3/1995 | Chang | 16/115 |
| 5,497,865 | 3/1996 | Yun-Pi | 16/115 |
| 5,500,981 | 3/1996 | Ho | 16/115 |
| 5,502,876 | 4/1996 | Wang | 16/115 |

*Primary Examiner*—Chuck Y. Mah

[57] ABSTRACT

A multistage adjustable device for trunk bracket has a fixed handle, a driving handle, two inner sleeves, two drawbars, two brakes, two seats, two checking bodies, two outer sleeves and two positioning plates. The fixed handle has two ends. Two sockets are disposed in the corresponding ends of the fixed handle. The front end of the inner sleeve is inserted in the socket. A slot is formed on the socket and a corresponding slot is formed on the inner sleeve. Two recess holes are formed in the two end portions of the fixed handle. Each end of the driving handle has a fin which has a hole to be hooked by a hook at the upper end of the drawbar. Two posts protrude upwardly on the two end portions of the driving handle. The posts are inserted in the recess holes. A hollow inner sleeve connects the socket. The lower end of the drawbar is inserted in the brake which has a stop portion and a shaft sleeve. The checking body has a cap and a positioning rod. The hollow outer sleeve has two compartments to receive a positioning plate and a seat.

1 Claim, 3 Drawing Sheets

MULTISTAGE ADJUSTABLE DEVICE FOR TRUNK BRACKET

BACKGROUND OF THE INVENTION

The invention relates to a trunk bracket. More particularly, the invention relates to a multistage adjustable device for a trunk bracket.

A conventional trunk has a tractile bracket at the back of the trunk. The tractile bracket has an inner sleeve and an outer sleeve. Two positioning bolts screw the inner sleeve and the outer sleeve tightly. However, a user has to loosen the bolts in order to adjust the tractile bracket. Further, the inner sleeve and the outer sleeve are easily deformed after a long period of usage.

SUMMARY OF THE INVENTION

An object of the invention is to provide a multi-step adjustable device for a trunk bracket so that the bracket can be protruded or retracted arbitrarily.

Accordingly, a multistage adjustable device for trunk bracket has a fixed handle, a driving handle, a pair of inner sleeves, a pair of drawbars, a pair of brakes, a pair of seats, a pair of checking bodies, a pair of outer sleeves and a pair of positioning plates. The fixed handle has two ends extending downwardly. Each of the two sockets is disposed in the corresponding ends of the fixed handle, respectively. The front end of the inner sleeve is inserted in the socket. A slot is formed on the socket and a corresponding slot is formed on the front end of the inner sleeve. Two recess holes are formed in the two end portions of the fixed handle, respectively. A compressed spring is inserted into the recess hole. Each end of the driving handle has a fin extending transversely therein. A hole is formed at the center of the fin to be hooked by a hook which is disposed at the upper end of the drawbar. Two cylindrical posts are protruded upwardly on the two corresponding end portions of the driving handle. The posts are inserted in the corresponding recess holes, respectively. A hollow inner sleeve is connected to the socket at the end of the fixed handle. The lower end of the drawbar is inserted in a shaft sleeve of the brake. The brake has a stop portion and a shaft sleeve extending upwardly from the stop portion. The stop portion and the checking body block each other. The seat has a movable portion with a transverse hole therein and an inserting portion extending upwardly from the movable portion. A longitudinal recess is formed on the inserting portion. A checking body has a truncated cone shaped cap and a positioning rod extending from the cap. A compressing spring and the positioning rod are inserted into the transverse hole. The hollow outer sleeve has two inner plates to separate the interior of the outer sleeve into two compartments. The first compartment of the outer sleeve receives a positioning plate which has a plurality of positioning holes to receive the positioning rod. The second compartment receives the seat.

DETAILED DESCRIPTION OF THE INVENTION

Figure 1:
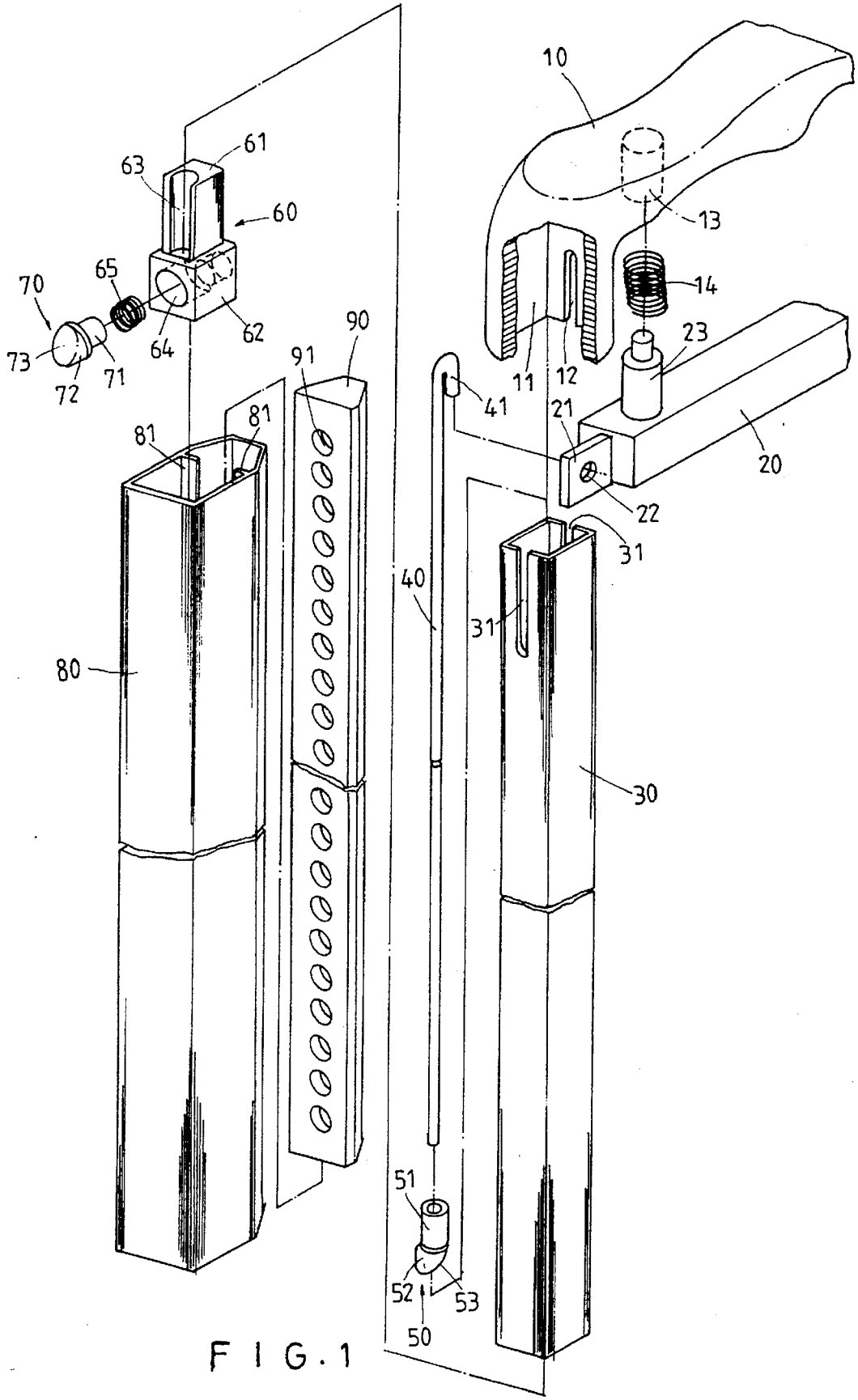
FIG. 1 is a partly perspective exploded view of a preferred embodiment in accordance with the invention.

Referring to FIG. 1, a multistage adjustable device for trunk bracket has a fixed handle 10, a driving handle 20, a pair of inner sleeves 30, a pair of drawbars 40, a pair of brakes 50, a pair of seats 60, a pair of checking bodies 70, a pair of outer sleeves 80 and a pair of positioning plates 90.

The fixed handle 10 has two terminal ends extending downwardly. Each of the two sockets 11 is disposed in the corresponding terminal ends of the fixed handle 10, respectively. The front end of the inner sleeve 30 is inserted in the socket 11. A slot 12 is formed on the socket 11 and a corresponding slot 31 is formed on the front end of the inner sleeve 30 in order to be inserted by a fin 21 extending from the end of the driving handle 20. Two recess holes 13 are formed in the two end portions of the fixed handle 10, respectively. A compressed spring 14 is inserted into the recess hole 13.

Each end of the driving handle 20 has a fin 21 extending transversely therein. A hole 22 is formed at the center of the fin 21 to be hooked by a hook 41 which is disposed at the upper end of the drawbar 40. Two cylindrical posts 23 are protruded upwardly on the two corresponding end portions of the driving handle 20. The posts 23 are inserted in the corresponding recess holes 13, respectively.

The hollow inner sleeve 30 is connected to the socket 11 at the end of the fixed handle 10.

The lower end of the drawbar 40 is inserted in a shaft sleeve 51 of the brake 50.

The brake 50 has a stop portion 52 with an inclination 53 and a shaft sleeve 51 extending upwardly from the stop portion 52. The stop portion 52 and the checking body 70 block each other.

The seat 60 has a movable portion 62 with a transverse hole 64 therein and an inserting portion 61 extending upwardly from the movable portion 62. A longitudinal recess 63 is formed on the inserting portion 61.

A checking body 70 has a truncated cone shaped cap 72 with an inclination 73 thereon and a positioning rod 71 extending from the cap 72. A compressing spring 65 and the positioning rod 71 are inserted into the transverse hole 64.

The hollow outer sleeve 80 has two inner plates 81 to separate the interior of the outer sleeve 80 into two compartments. The first compartment of the outer sleeve 80 receives a positioning plate 90 which has a plurality of positioning holes 91 to receive the positioning rod 71. The second compartment receives the seat 60.

Figure 2:
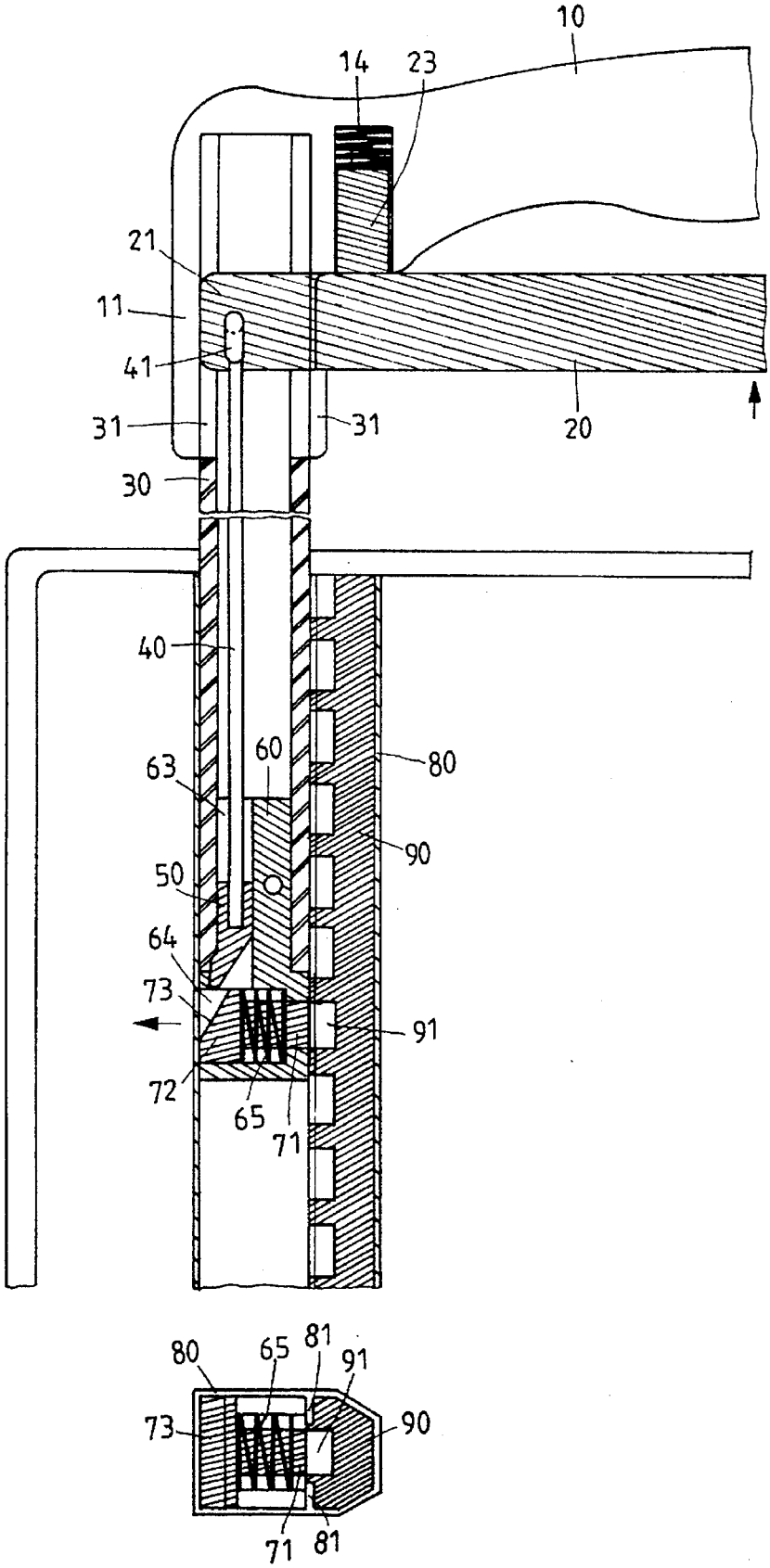
FIG. 2 is a partly cross-sectional view illustrating that a checking body is free from positioning holes.
Figure 3:
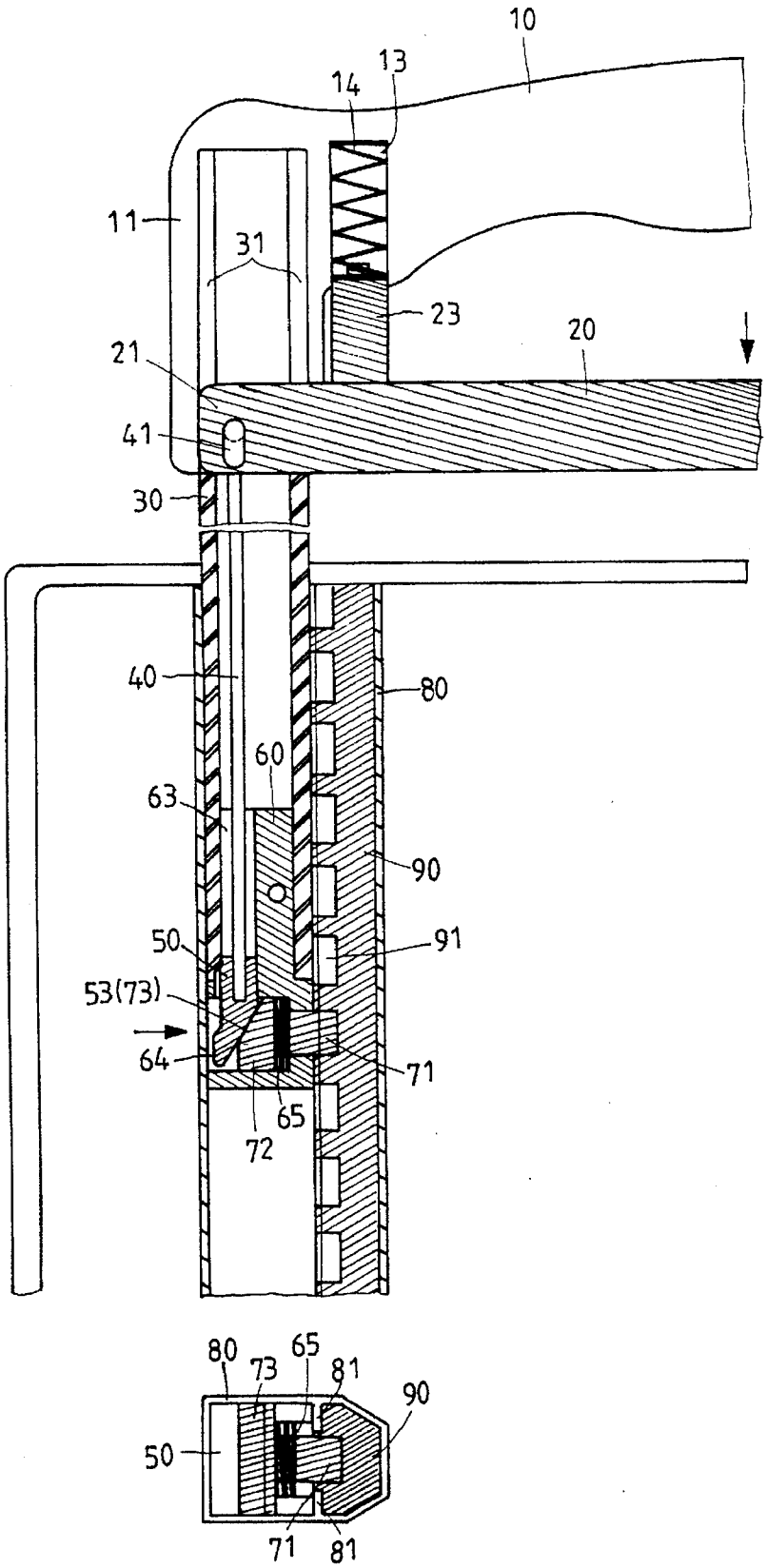
FIG. 3 is a partly cross-sectional view illustrating that a checking body is positioned by a positioning hole.

FIG. 2 illustrates that a checking body 70 is free from the positioning holes 91. The driving handle 20 is pressed upwardly to move the drawbars 40 and the corresponding brakes 50 upwardly. The brakes 50 disengage from the corresponding checking bodies 70. Each of the compressing springs 65 rebound to force each of the corresponding positioning rods 71 disengaging from each of the corresponding positioning holes 91. FIG. 3 illustrates that a checking body 70 is positioned by a positioning hole 91. The driving handle 20 is released. The springs 14 force the driving handle 20, the corresponding drawbars 40 and the corresponding brakes 50 to move downwardly. The brakes 50 block the corresponding checking bodies 70 and force the corresponding checking bodies 70 to move toward the corresponding positioning holes 91. Each of the positioning rods 71 is inserted in each of the corresponding positioning holes 91.

The invention is not limited to the above embodiment but various modification thereof may be made. It will be understood by those skilled in the art that various changes in form and detail may be made without departing from the spirit and scope of the invention.

What is claimed is:

1. A multistage adjustable device for trunk bracket comprising:

a fixed handle having two terminal ends extending downwardly;

two sockets disposed in said corresponding terminal ends of said fixed handle, respectively;

a driving handle;

a pair of inner sleeves;

a pair of drawbars;

a pair of brakes;

a pair of seats;

a pair of checking bodies;

a pair of outer sleeves;

a pair of positioning plates;

a front end of each of said inner sleeves being inserted in each of said corresponding sockets, respectively;

a slot formed on each of said sockets and a corresponding slot formed on a front end of each of said inner sleeves;

two recess holes formed in two end portions of said fixed handle, respectively;

two springs being inserted into said recess holes, respectively;

each end of said driving handle having a fin extending transversely therein;

a hole formed at a center of each of said fins;

two cylindrical posts protruding upwardly on said two corresponding end portions of said driving handle;

two posts being inserted in said corresponding recess holes, respectively;

a lower end of each of said drawbars being inserted in each of said brakes, respectively;

each of said brakes having a stop portion and a shaft sleeve extending upwardly from said stop portion;

said stop portion and said corresponding checking body blocking each other;

each of said shaft sleeve receiving each of said lower end of said drawbars;

each of said seats having a movable portion with a transverse hole therein and an inserting portion extending upwardly from said movable portion;

a longitudinal recess formed on each of said inserting portion;

each of said checking bodies having a truncated cone shaped cap thereon and a positioning rod extending from said cap;

a compressing spring and a positioning rod being inserted into each of said transverse holes;

each of said hollow outer sleeves having two inner plates to separate an interior of each of said outer sleeves into a first and a second compartments, said first compartment receiving a positioning plate which has a plurality of positioning holes to receive said corresponding positioning rod and said second compartment receiving said corresponding seat, respectively;

wherein said driving handle is pressed upwardly to move said drawbars and said corresponding brakes upwardly, said brakes disengage from said corresponding checking bodies, each of said compressing springs rebound to force each of said corresponding positioning rods disengaging from each of said corresponding positioning holes; and wherein said driving handle is released, said springs force the driving handle, the corresponding drawbars and the corresponding brakes to move downwardly, said brakes block said corresponding checking bodies and force said corresponding checking bodies to move toward said corresponding positioning holes, and each of said positioning rods is inserted in each of said corresponding positioning holes.

* * * * *